US005426843A

United States Patent [19]

Bartky

[11] Patent Number: 5,426,843

[45] Date of Patent: Jun. 27, 1995

[54] METHOD FOR FORMING A SEAM-ROUNDED FERRULE ON JEWELRY AND PRODUCT MADE

[75] Inventor: W. Scott Bartky, Chicago, Ill.

[73] Assignee: ARI Imports, Inc., Chicago, Ill.

[21] Appl. No.: 187,709

[22] Filed: Jan. 27, 1994

Related U.S. Application Data

[63] Continuation-in-part of Ser. No. 3,321, Jan. 12, 1993, abandoned.

[51] Int. Cl.[6] ..... B21D 39/04; B21F 45/00

[52] U.S. Cl. ..... 29/516; 29/160.6; D11/13

[58] Field of Search ..... 29/160.6, 270, 275, 29/276, 517, 518, 516, 751; 72/410, 416; D11/11, 13; 81/424.5

[56] References Cited

U.S. PATENT DOCUMENTS

| | | | |
|---|---|---|---|
| 777,412 | 12/1904 | Hamel et al. | 81/91.4 |
| 2,327,683 | 8/1943 | Warna et al. | 29/518 |
| 2,583,625 | 1/1952 | Bergan | 29/517 |
| 2,731,862 | 3/1953 | Schinske | 72/410 |
| 2,763,171 | 9/1956 | Modrey | 72/410 |
| 3,175,281 | 3/1965 | Elfsten | 72/410 |
| 3,259,966 | 7/1966 | Canter | 72/410 |
| 3,396,571 | 8/1968 | Porter | 72/410 |
| 4,009,514 | 3/1977 | Couto | 29/751 |
| 4,219,919 | 9/1980 | Fischbein et al. | 29/270 |
| 4,637,084 | 1/1987 | Wood | 7/134 |
| 5,042,285 | 8/1991 | Levy | 72/410 |
| 5,058,252 | 10/1991 | Wiesner, III | 29/160.6 X |

FOREIGN PATENT DOCUMENTS

| | | |
|---|---|---|
| 3606429 | 9/1907 | Germany . |
| 966582 | 8/1957 | Germany . |
| 423868 | 7/1947 | Italy . |
| 5398 | 11/1920 | Netherlands . |

OTHER PUBLICATIONS

Poris, Ruth F. *Step-By-Step Bead Stringing*, Golden Hands Press 1991.

*Primary Examiner*—Timothy V. Eley
*Assistant Examiner*—Khan V. Nguyen
*Attorney, Agent, or Firm*—Olson & Hierl, Ltd.

[57] ABSTRACT

A method for compressively forming a ferrule about a cord is provided. The method utilizes two successive compressive forming steps. In the first step, the starting ferrule is formed into a crescent-like configuration in side elevation. In the second step, the crescent-like configuration is formed into a cardioid-like configuration in side elevation. The method can be practiced using a hand-operated forceps that is equipped with shaping dies. The resulting so formed ferrule displays superior cord holding and retaining characteristics.

17 Claims, 2 Drawing Sheets

METHOD FOR FORMING A SEAM-ROUNDED FERRULE ON JEWELRY AND PRODUCT MADE

RELATED APPLICATION

This application is a continuation-in-part of my earlier filed U.S. patent application Ser. No. 003,321 filed on Jan. 12, 1993, now abandoned.

FIELD OF THE INVENTION

The present invention relates to a method for forming ferrules around cords for jewelry, fishing lines and the like using a ferrule-forming forceps (preferably hand operated).

BACKGROUND OF THE INVENTION

Metal ferrules are desirable for securing cords, such as strands of wire or the like, where closed-loop connection is desirable, for example, in fastening jewelry clasps and like findings, posts, netting frames and the like.

In the jewelry arts, cords comprised of, for example, monofilament, braided strands or cording of natural or synthetic origin, jewelry wire and the like are used for stringing beads and like stringable objects for making closed-loop articles of jewelry, such as necklaces, bracelets, belts and the like which may incorporate interengaging but releasable cooperating clasp pairs. For instance, a cord that is a flexible, plastic-coated, multiple stranded, cable-type stainless steel wire, commonly called "jewelry wire" or "tiger tail", is highly desired because of its strength characteristics.

For convenience, the term "cord" is used generically herein to include both natural and synthetic organic and inorganic (including metal) strands, filaments (monofilament or polyfilament), threads, cords, wires (including jewelry wire) and the like, whether coated or uncoated, or single or multiple stranded. Preferably, a cord has the flexibility, strength and suitable fine diameter that make it suitable for use in forming an article of jewelry, such as a necklace, bracelet, belt, broach or the like which article comprises or incorporates string beads or other stringable objects that are strung on a cord.

The term "ferrule" is used herein to indicate a small torroidal or ring like structure comprised of a ductile or formable material which is preferably a metal, such as steel, soft brass, copper, silver, sterling silver, aluminum, alloys thereof and the like. A ferrule can have a gold or silver plate finish or other finish coating. A ferrule can be, in example, of the type that is commonly used to secure the free end of a looped cord that has been passed through an eyelet or the like that is associated with a jewelry clasp or the like.

The term "free end of a cord" and equivalent grammatical variations thereof, as used herein, refers generally to the leading or terminal length of a cord, such as the length extending beyond the first or last bead (or strung object) in a string of beads (or strung objects) intended to comprise a closed-loop article of jewelry.

As those familiar with the art of jewelry making will appreciate, a closed-loop article of jewelry is generally finished by interconnecting a pair of opposed terminal loops of cord where each such loop is at a different opposite end of a plurality of strung beads or the like. At each opposite strung cord end, cord is formed into a terminal loop. In each loop, a different one of a pair of interengagable jewelry clasps is held. Thus, the respective opposite ends of a strung cord are each associated with a different one member of a pair of interengagable clasps. When the clasps are engaged, the closed loop article of jewelry is formed. A pair of interengagable jewelry clasps can comprise any one of various two-piece matable closures, such as, for example, a hook and an eye, a crab claw and a ring, ratchet-like clasp connectors, or the like. Each member of a clasp connector pair typically is provided with a ring, ear, or eyelet, or other fastening member with which the free end of a cord is secured, engaged, strung, or the like. For convenience, such a fastening member that is associated with a clasp member or the like is termed a "connection member" herein.

In conventional jewelry making practice, a ferrule that is used for cord securing purposes as in a looped article of jewelry or the like is first threaded or strung circumferentially over the free end of a cord. Conventionally, the ferrule is regarded as a bead, or a short tube, that is sometimes called a "French" crimp, a "finishing bead", or a "crimp cylinder". The free end of the cord is next typically threaded or strung through a connection member of a clasp connection and then is looped back and passed again through the same ferrule. The ferrule thus typically contains adjacently two cord portions, namely, a portion of the captured cord leading from the last one of the previously strung beads or the like and a cord portion adjacent the cord end, both of which portions must be secured together to stabilize and maintain the thus formed loop. The resulting ferrule is subsequently compressed diametrically against both radially adjacent cord portions to form a cord securing fastener which, ideally, then immovably anchors or fastens the adjacent cords together with the terminal loop being fastened or retained to the connection member. A similar procedure can be followed for anchoring the opposing free end of the same cord of the looped article of jewelry to the connection member of the interengagable second one of the selected clasp connector pair.

Preferably, the cord securing ferrule provides an attractive element in a finished article of jewelry or is small enough to be inobtrusive. In compressing a ferrule with a hand-operated tool such as a pliers, however, it is difficult to uniformly radially deform the ferrule about its circumference to a smaller diameter and still keep it attractively rounded. For large volume production of standardized jewelry, specially designed, sophisticated powered machinery can be used which can uniformly deform a ferrule to form a smooth and inobtrusive cord fastener. However, an individual jewelry artisan and practitioner, such as designers, crafts persons, small-volume custom jewelry manufacturers, and the like do not usually have access to such costly, sophisticated powered machinery. Consequently, producers of hand-made jewelry, whose products clearly would benefit from using jewelry wire and like cords, tend not to use such cords owing to the lack of low-cost, reliable, effective, easily-used, hand-operatable ferrule forming or compressing equipment and procedures.

Heretofore, the only ferrule-forming tools generally available and recommended for use by individual jewelry artisans and practitioners were conventional pliers, such as a flat nose pliers or the like. Indeed, general jewelry-making texts simply instruct the artisan to flatten (that is, crimp) the ferrule between the jaws of a conventional pliers. However, pliers generally are ill suited for forming a well shaped and rounded compressed ferrule, especially when using the relatively small ferrules desired for articles of jewelry.

Thus, in the prior art of jewelry making, the end result obtained by diametrically deforming (i.e, crimping) a ferrule by hand with a conventional flat-nosed pliers is a flattened ferrule having a generally unaesthetic appearance. Not only does such a flattened ferrule detract from the overall appearance of the resulting article of jewelry, but also such article frequently has rough edges that are associated with the crimped ferrule which can scratch the skin or clothing of the wearer.

Also, the compressive force exertable by hand upon a ferrule generally either is insufficient to obtain an adequate strong tight securement about cord portions, or is excessive so that the portions of a cord that are located in or adjacent to a compressed ferrule can be flattened or even partly cut and damaged (and thereby weakened). The problem of insufficient or improper ferrule crimping, for example, is experienced commonly by persons who are very young, very elderly or suffering from muscular weakness in the hands as from carpal tunnel syndrome, hand injury, arthritis or the like. If cord securement by a ferrule is not sufficient, then the free end of the secured cord eventually can loosen from the compressed ferrule and disengage itself from the associated clasp member. This increases the risk of loss of some or all of the strung beads, or even the entire article of jewelry.

Further, in the prior art, even a properly crimped (that is, a diametrically flattened) ferrule characteristically has relatively poor cord retaining capability relative to the cord or cords which have been threaded through the ferrule before the crimping. With the passage of time, and/or through the normal stresses and strains that occur through jewelry usage, there is a tendency for the flattened ferrule to loosen or expand. Even a very slight dimensional change in a diametrically flattened ferrule can result in a diminution or relaxation of the initial holding capacity of the flattened ferrule against the cord(s) therein, thereby permitting unwanted and undesirable longitudinal cord movement and slippage relative to the deformed ferrule.

Another problem is that conventional pliers are not configured for use between closely spaced beads and jewelry findings, or for use in compressing relatively small cylindrical objects such as a ferrule to produce an aesthetic shape. For example, a typical initially round ferrule known as a "crimp bead" can be about 0.09 inches (about 2.25 millimeters) in both length and diameter, and a typical tubular ferrule known as a "crimp cylinder" can vary in diameter from about 0.06 inches (about 1.5 millimeters) to about 0.12 inches (about 3 millimeters) and in length from about 0.25 inches (about 6.25 millimeters) to about 0.5 inches (about 12.5 millimeters).

Accordingly, there is a need in the jewelry making art for a relatively simple, low cost hand tool that is useful for forming a ferrule in such a way that the resulting formed ferrule has an attractive, relatively smooth, rounded shape end. Also, such a tool should require only a relatively small amount of manual compressive force to form a ferrule.

In addition, and most importantly, there is a need in the jewelry making art for a new and improved method for forming and affixing a ferrule to a cord so that a superior mechanical attachment results between the cord and the affixed ferrule.

These needs are met by the therein disclosed inventive, ferrule-forming forceps and ferrule-forming method.

SUMMARY OF THE INVENTION

The present invention relates to a new and very useful method for compression forming a formable ferrule into retaining engagement circumferentially about cord means and to the resulting combination of formed ferrule and retained cord means.

More particularly, by the present method, a formable ferrule having cord means extended therethrough is first diametrically compressed about the cord means so as to form the ferrule into a generally crescent-like configuration having in side elevation a concave perimeter portion, a convex perimeter portion that is in adjacent, opposed relationship to said concave perimeter portion, and also a pair of convex opposite end perimeter portions.

Then, the opposite end perimeter portions of the crescent-like configuration are compressed towards each other so as to form the crescent-like configuration into a generally cardioid configuration having in side elevation a projecting region that is derived from the convex perimeter portion and a furrowed region that is derived from the concave portion.

The resulting so formed combination of ferrule and cord means displays superior cord retention and durability characteristics.

These ferrule forming operations are conveniently carried out using a hand-operated ferrule-forming forceps. The forceps is provided with cooperating shaping dies as disclosed herein that are useful for carrying out the ferrule forming operations.

The diametrically so compressed ferrule that has the crescent-like configuration thus has a medial depression or indentation or seam at a side location. This indentation effectively provides in such intermediately formed ferrule an axially extending, diametrically curved medial duct or channel. This duct is capable of holding therein the cord means that extends therethrough. Preferably the cord means comprises either two or four cord members, and such cord members are preferably distributed so as to be at opposed side end regions of the duct.

The diametrically so compressed ferrule is then further compressed and rounded by compressing together the opposite end perimeter portions of the crescent-like configuration. This second compression folds the medial indentation of the crescent-like configuration into a seam, thereby to provide a seam-rounded ferrule product. A seam-rounded ferrule prepared by the method of this invention substantially immovably secures each cord that extends through the duct of the intermediate seamed ferrule.

As disclosed herein, a seamed ferrule embodying the principles of this invention is easily and preferably formed by the inventive method by employing a hand-operated ferrule-forming forceps that has certain associated coactive die features as disclosed herein.

Such a forceps comprises a pair of independent lever members, each having a jaw portion and an elongated handle portion extending from the jaw portion. One lever member is movably coupled to the other lever member by an interconnecting pivot means extending between overlying adjacent mid-regions of the lever members with their respective jaw portions generally facing each other. When the handle portions are manually manipulated (i.e., extended and retracted relative to one another by pivoting about the pivot means), the jaw portions are correspondingly moved between an opposed open position and an opposed coactive closed position relative to one another. Each one of the jaw portions has a pair of longitudinally adjacent die members. Each die member of one jaw member is aligned with a mating die member of the other jaw member so that the respective aligned pairs of die members can coact with one another as the handle portions are reciprocated.

The die members are preferably positioned in the jaw portions for achieving a maximum leverage relative to the pivot member with a minimum amount of manually applied compressive force.

One pair of die members is adapted for use in the first ferrule compression forming operation where the ferrule being formed is diametrically compressed. The second pair of die members is adapted for use in the second ferrule forming operation where the previously so compressed intermediate ferrule is again compressed while oriented at about 90° relative to its spatial position during first or diametrical compression. The second pair of the die members are adapted to define a seam-rounding die, and thus preferably has a cross-sectional area that is substantially smaller than the cross-sectional area of the seam-forming die defined by the first pair of dye members.

A product formed seam-rounded ferrule produced by the ferrule forming method of the present invention characteristically substantially immovably secures cords held therein.

In the field of jewelry, a cord securing seam-rounded ferrule formed from a ferrule in accordance with the inventive method is sufficiently attractive to be employed as a decorative bead member in an article of jewelry.

Such hand operated ferrule-forming forceps are particularly convenient for purposes of practicing the method of this invention. Use of such a forceps enables the user to produce a smooth, attractive, inobtrusive formed securing ferrule. Also, such a forceps enables the user to form a substantially taut securing ferrule by the method of this invention with only a minimal amount of applied force. Further, use of such a forceps provides a low cost means for reliably forming a securing ferrule for jewelry or the like from a conventional ferrule.

Numerous other features and advantages of the present invention will become apparent from the following detailed description of the invention, the accompanying drawings and the appended claims.

DETAIL DESCRIPTION OF THE PREFERRED EMBODIMENTS

Figures 1, 2, 3, 4, 5, 6A, 6B, 6C, 7, 8, 9A, 9B, 10:
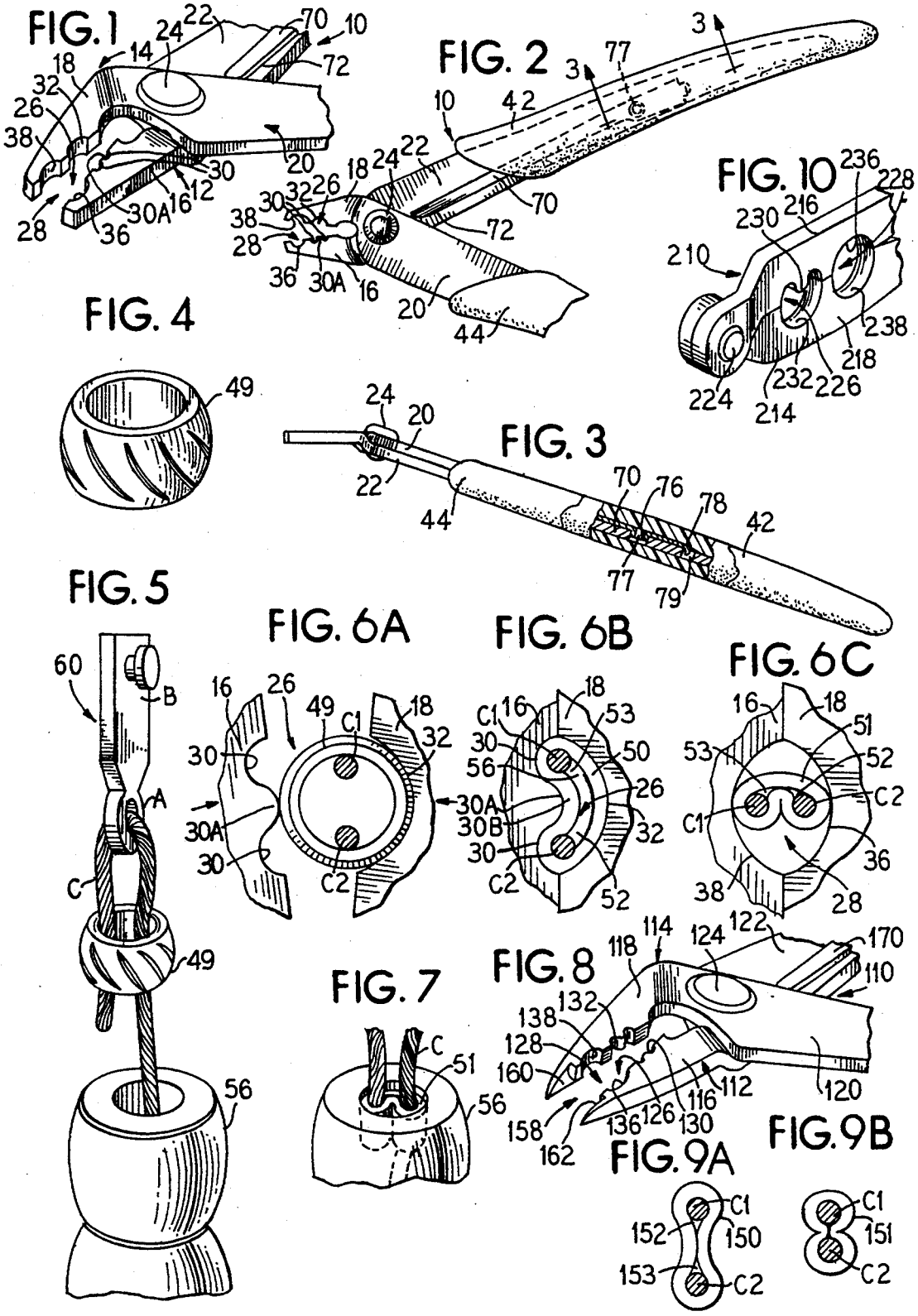
FIG. 1 is a fragmentary perspective view of the jaw portions of one illustrative and preferred forceps embodiment that is suitable for use in the practice of this invention, this view showing the relationship of the dies to the pivot means.
FIG. 2 is a fragmentary side elevational view of the forceps embodiment of FIG. 1, thus view showing the relationship of the biasing means to one of the handle portions.
FIG. 3 is an edge elevational view of the forceps embodiment of FIGS. 1 and 2, some parts thereof being broken and some parts thereof being shown in section, this view including a partially cut away fragmenting sectional portion showing the forceps in an operative closed position and also the relationship of the biasing means to the handle, the fragmentary sectional portion being taken along the line of 3—3 of FIG. 2.
FIG. 4 is a greatly enlarged perspective view of one embodiment of a ferrule that is suitable for use in the portion of the invention, the ferrule being shown prior to its formation by the method of this invention into a seam-rounded ferrule having generally a cardioid configuration.
FIG. 5 is a perspective view of the ferrule of FIG. 4 that is illustratively shown in loose association with a portion of the free end of a cord that is extended therethrough, this cord being threadably engaged with an exemplary connection member, and being looped back through the ferrule before ferrule formation is undertaken using a forming forceps such as shown in FIGS. 1–3 and also the method of this invention.
FIG. 6A, 6B and 6C are progressive side elevational views illustrating stages in the forming of an illustrative ferrule, such as shown in FIGS. 4 and 5, using the forceps shown in FIGS. 1–3, some parts thereof being broken away and some parts thereof being shown in section, FIG. 6A showing the ferrule in a starting position for compression forming in the seam-forming die of the forceps, FIG. 6B showing the immediate formed ferrule in the immediate seam-forming die after the forceps are hand-operated and compressed closed to a closed position, and FIG. 6C showing the product ferrule in the seam-rounding die of the forceps after the intermediate ferrule has been rotated about 90° and transferred from the seam-forming die to the seam-rounding die and after the forceps are then hand-operated and again compressed to a closed portion.
FIG. 7 is a fragmentary perspective view of a formed ferrule that has been produced as illustrated in FIG. 6C, this view illustrating one of the advantageous uses for such a formed ferrule.
FIG. 8 is a fragmentary perspective view of an alternative structure for the jaws portion of a forceps suitable for ferrule forming in producing a seamed ferrule having two opposing seams in the seam-forming die, such jaws portion further including a cutter means.
FIGS. 9A AND 9B are progressive side elevational views similar to FIGS. 6A, 6B and 6C illustrating stages in the forming of a ferrule using the forceps shown in FIG. 8.
FIG. 10 is a fragmentary perspective view of a further alternative embodiment of a forceps embodiment wherein the lever members are end pivoted with the jaws portions being adjacent to the pivot member.

The method for forming a seam-rounded ferrule in accordance with this invention in two illustrative and successive compression steps will be discussed in connection with the description of hand-operated forceps having certain shaping die features, such forceps being useful for performing the method.

While the forceps can be in many different forms, presently preferred embodiments are shown in the drawings and are described herein for illustrative purposes.

The term "seam-rounded" as used herein refers to the formed compressed ferrule which is produced from the second compression step upon a starting ferrule. In this second step, the formed seam of the first compression step is compressively folded inwardly preferably in the presence of a seam-rounding die. It is to be understood that although a ferrule that is formed by the method of the present invention is illustrated to have its perimeter be in a generally rounded form, the invention is not limited to the production of a formed ferrule having a single configuration. For example, in the second compressing step of ferrule forming, a seam-rounding die can be configured to impart a square-type or oval-type of shape to the completely formed and seam-rounded ferrule, if desired.

In general, a ferrule that is formed compressively by the method steps of this invention has retained and enclosed therewithin a cord means. Such cord means comprises at least one cord member. However, preferably the cord means comprises two cords or even four cord members. An even number of starting cords extended or strung through a starting ferrule is preferred but is not required. While more than four cords can be extended through a single ferrule, it is presently preferred to use not more than four cords because then, as those skilled in the art will readily appreciate, a stronger and more durable retention of the cords by the formed ferrule seems to be achievable by the method of the invention.

Characteristically, a ferrule that is formed about the cord means by the two-step ferrule compression forming procedure disclosed in this invention has a characteristic heart-like or cardioid-like shape. Thus, such a formed ferrule generally has in side elevation the shape of a geometric figure of the cardioid type that is defined by a pair of convex, convolutely extending, preferably mirror-image related, opposed sides which have respective opposite ends that adjoin, thereby to define adjacent one pair of such adjoining ends a radially outwardly projecting or extending region and also to define adjacent the opposed pair of such adjoining ends an radially inwardly furrowed or seamed region.

Because of the desirable tendency for a product compressed ferrule to wrap around portions of each cord that has been extended therethrough, it is desirable to have the open central aperture of a starting ferrule have a cross-sectional area that is substantially greater than the total cross-sectional area of the cord(s) that are extended therethrough. A present preference is for a starting ferrule to have a cross-sectional area that is at least about 5 times greater than the total cross-sectional area of such so extended cords. The presently preferred ratio of ferrule cross-sectional area to cord cross-sectional area is about 20 to 1. However, larger and smaller of such ratios can be utilized without departing from the spirit and scope of this invention, as those skilled in the art will appreciate. One reason why a ferrule which has been formed by the method this invention holds and retains two cords so well is that each cord is individually wrapped by the formed cardioidally shaped ferrule over at least about 180° of its enclosed circumferential outer surface.

So long as a starting ferrule is formed by seaming (or intermediate crescent formation) in one step and then enclosing the seam within itself (or final cardioid formation) in a second step, the principles of this invention are practiced. For ease of description, the illustrative and presently preferred forming forceps described are suitable for use in the jewelry trade. However, the precise shapes and sizes of the components employed in the forceps are not essential to the invention, unless otherwise indicated, as those skilled in the art will appreciate.

Referring to FIGS. 1–3, there is seen a forceps 10 that incorporates a pair of independent lever members 12 and 14. Each one of the lever members 12 and 14 has a jaw portion 16 and 18, and an elongated handle portion 20 and 22, respectively, extending from each jaw portion 16 and 18. The lever members 12 and 14 are movably and pivotably coupled to one another by a pivot member 24 with the jaw portions 16 and 18 generally facing each other. This coupling also provides a lever point or fulcrum at or near the pivot member 24.

The pivot member 24 is illustrated for convenience in the form of a screw, or a rivet with a head at one end and a retaining ring adjacent the opposite end, or the like, such as commonly found in pliers. It is understood that the pivot member 24 can take any form, so long as it provides, and is located so as to provide, leverage that preferably minimizes the mechanical force required in the forming a ferrule with the dies that are associated with the forceps 10, as described herein.

The jaw portions 16 and 18 are placed between an opposed open position and an opposed coactive closed position relative to one another when the handle portions 20 and 22 are manually manipulated. As best seen in FIGS. 1 and 2, the jaw portions 16 and 18 have die features which define two independent coactive dies when the respective die members are mated. Each die is defined by a pair of aligned die members in jaw portions 16 and 18 as discussed below.

As illustrated, one of the dies is the seam-forming die 26 that is used to form an intermediate seamed ferrule in the first step of the disclosed method. The second die is the seam-rounding die 28 that is used for rounding the seam of the seamed ferrule in the second step of the disclosed method as discussed below thereby to form the product formed ferrule. For maximizing leverage and minimizing required compression force, the seam-forming die 26 preferably is positioned immediately adjacent to the pivot member 24.

The die members of the seam-forming die 26 preferably are defined as a pair of aligned recesses 30 and 32 in the jaw portions 16 and 18, respectively, and are adapted to receive and support therein a ferrule for seaming. For convenience, and not by way of limitation, one embodiment of a ferrule 49 is illustrated in FIG. 4.

As seen in FIGS. 1 and 2, the die member 32 of the seam-forming die 26 preferably is defined as a generally concave recess that is substantially uniform in curvature throughout its length. As illustrated, the die member 32 is preferably in the form of a semi-circle. The die member 30 preferably of the seam-forming die 26 is defined as a pair of generally concave recesses having there between a convex raised seaming portion 30A centrally defined therein (see FIG. 2).

Preferably, the convex seaming portion is generally rounded and laterally projects sufficiently to deform one wall of the ferrule 49 when it is received in the seam-forming die 26 and the jaw portions 16 and 18 are in coactive relationship to a closed position and without projecting into the recess of die member 32. The projection of the convex seaming portion can be varied., if desired. However, to practice the method of this invention, the projection of the convex seaming portion need only be sufficient to produce a medial longitudinal indentation in the sidewall of a ferrule which is sufficient to cause the ferrule to compress upon itself locally and also against the portions of the cords that are captured within the ferrule when the second compression step is carried out. The foregoing die members can be each defined in either one of the jaw portions 16 or 18 and are here shown as illustrated for convenience only.

The seam-rounding die 28 is defined preferably by a pair of substantially similar concave recesses 36 and 38 which are substantially uniform along their length.

The method of forming a ferrule for an article of jewelry 60 is generally illustrated in FIGS. 5, 6A, 6B and 6C. To prepare the starting ferrule 49 for ferrule formation, the free end of cord C from the article of jewelry is threaded through the ferrule 49, which captures a cord portion leaving a predetermined length of the free end of the cord C to be threaded through the ear A of the clasp connector B, illustrated in FIG. 5 as one part of a two-part clasp. The so-connected free end of the cord C is then looped back through the ferrule 49 to place the captured cord portion C1 and the looped-back cord portion C2 of the cord in independent substantially parallel spaced adjacent relationship relative to one another within the ferrule 49, as best seen in FIGS. 5 and 6A.

In the first compression step of the method, the ferrule 49 is then received between the die members 30 and 32 of the seam-forming die 26 as illustrated in FIG. 6A. The handle portions 20 and 22 of the forceps 10 are manually manipulated to coactively close the jaw portions 16 and 18 in the direction indicated by the arrows. This closure compresses and deforms one sidewall of the ferrule 49, thereby forming the starting ferrule 49 into a generally crescent-like intermediate seamed ferrule configuration 50 when viewed in side elevation which has one medial longitudinal concave indentation 30B along its axial length as illustrated in FIG. 6B. As also illustrated in FIG. 6B, the indentation 30 forms the seam of a seamed ferrule 50 having an arcuate internal duct or channel 56. Preferably, cord C1 is located in one end 53 of the duct 56 and cord C2 is located in the opposite end 52 of this duct 56.

The seamed ferrule 50 is then removed from the seam-forming die 26 and is rotated about 90° relative to the forceps 10 and thereby is oriented so as to be receivable between the die members 36 and 38 of the seam-rounding die 28 (see FIG. 6C). Thus, the seam or indentation 30B of seamed ferrule 50 is initially in substantially collinear relationship with the die member 32 in the jaw portion 18. The opposite longitudinal end portions of the seamed ferrule 50 are each initially engaged with a different respective one of the die members 36 and 38. The seamed ferrule 50 is then compressed along an axis that is generally perpendicular to the seam 30B, thereby to compress and fold the indentation 30B radially and inwardly (relative to the seamed ferrule 50) as the jaw portions 16 and 18 are closed coactively to their closed position, as illustrated in FIG. 6C. For this purpose, the cross-sectional area of the seam-rounding die 28 is preferably less than that of the seam-forming die 26. The seam-rounding die 28 is sized and shaped to receive and support the seamed ferrule 50 as oriented in a position for longitudinal compression which position is normally substantially perpendicular to the seam 30B, as illustrated in FIG. 6C.

Thus, in the second compression step of the method, the seam-rounding die 28 compressively folds the seam 30B of the seamed ferrule 50 radially inwardly at the medial indentation 30B when the jaw portions 16 and 18 are mated in a coactive closed position. This compression forms a seam-rounded ferrule 51 that substantially immovably secures each of the strands. For such compression folding, the seamed ferrule 50 is here oriented by physically rotating the seamed ferrule 50 about 90° from its seamed position in the seam-forming die 26, or, alternatively, by manually orienting the operating position of the forceps about 90° from its position in the first step.

It is understood that, as illustrated in FIG. 5, the cord C has previously been threaded through a plurality of jewelry beads or the like for incorporation with the article of jewelry 60 and that the ferrule 49 is intended to be formed into a securing ferrule to complete end region of the article of jewelry 60.

The seam-rounded ferrule 51 that is formed by the method of this invention employing the foregoing forceps 10 is generally smooth and .sufficiently attractive to be a decorative finishing bead itself for use in an article of jewelry, particularly when the finishing bead is composed of a so-called precious metal, such as sterling silver or the like. Further, a sufficiently small outside diameter is obtainable in a ferrule 51 so that the seam-rounded ferrule 51 can be inobtrusively hidden, if desired, within the recesses of an adjacent tubular member having a larger inside diameter, such as in the terminal bead 56 of the article of jewelry 60, as illustrated in FIG. 7.

Figure 11A:
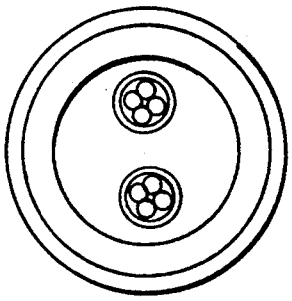
FIGS. 11A, 11B and 11C are progressive side elevational views similar to FIGS. 6A, 6B and 6C, but showing coated cords that incorporate multiple strands (here illustratively four strands)
Figure 11B:
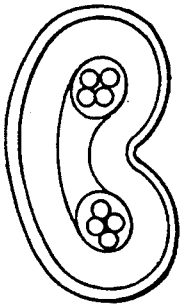
Figure 11C:
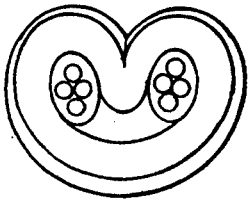

Referring to FIGS. 11A–11C, there is seen a progressive set of figures that is similar to FIGS. 6A–6C except that here the two cords employed are each coated and have multiple strands. Observe that a slight flattening of each cord is achieved which is believed to aid in obtaining a secure association between the ferrule and the cords.

Figure 12A:
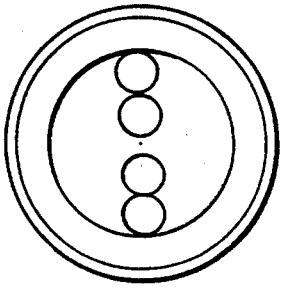
FIGS. 12A, 12B and 12C are progressive elevational views similar to FIGS. 6A, 6B and 6C, but showing four cords.
Figure 12B:
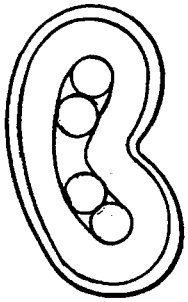
Figure 12C:
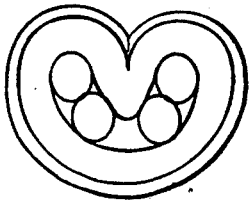
Figure 13:
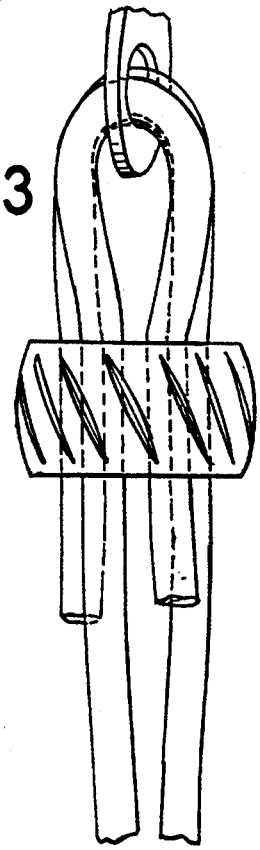
FIG. 13 is a view similar to FIG. 5 but showing the ferrule in association with four cords.

Referring to FIGS. 12A–12C, there is seen a progressive set of figures that is similar to FIGS. 6A–6C except that here four cords are employed. FIG. 13 illustrates one manner in which four cords are usable for association with a jewelry fastener.

Alternative jaw portions of a forceps embodiment designated generally by the reference numeral 110 are illustrated in FIG. 8. In this embodiment, each one of the die members 130 and 132 of the seam-forming die 126 is defined as a substantially similar concave recess having a convex seaming portion centrally defined therein as in the die member 30 of forceps embodiment 10. As in forceps embodiment 10, the convex seaming portion of each of the die members 130 and 132 is generally rounded and laterally projects sufficiently to deform one wall of a tubular member received in the seam-forming die when the jaw portions are in closed position without projecting into the recess of the other die member.

As seen in FIG. 9A, the seam-forming die 126 produces a seamed ferrule 150 having two opposed medial longitudinal indentations, defining two substantially parallel ducts 152, 153, when the foregoing method is practiced. In this embodiment, the seam-rounding die 128 is again defined by two substantially similar semicircular recesses 136 and 138. Thus, as illustrated in FIG. 9B, the seamed ferrule 150 can be compressed along an axis perpendicular to the opposing seams to produce the seam-rounded ferrule 151.

As illustrated in forceps embodiment 110, a cutter means 158 can be included for convenience defined as a pair of cutter members 160 and 162 in jaw portions 116 and 118. As illustrated, the cutter means 158 is positioned at the terminus of the jaw portions 16 and 18 but is not so limited. It is understood that the cutter means can be positioned on either side of the pivot means or between the dies, so long as it does not interfere with the practice of the principles of this inventions.

As can be seen by the alternate jaw portions of another forceps embodiment designated generally by the reference numeral 210 illustrated in FIG. 10, the seam-forming die 226 and the seam-rounding die 228 can be positioned rearward of the pivot means 224. As illustrated, the seam-forming die 226 preferably is adjacent to the pivot means 224 and has die members 230 and 232 defined as in embodiment 10, but is not so limited. It is understood that the seam-forming die 226 can also be configured to form two seams similar to that of the seam-forming die 126. In the alternate jaw portions 216 and 218, the seam-rounding die 228 is defined by two aligned substantially semicircular recesses as in embodiment 10.

In the forceps of this invention, the seam-forming die preferably is positioned adjacent the seam-rounding die, but it is understood that the two dies can be positioned at any convenient spaced apart relationship. Preferably the forceps include a hand protective, cover means on each one of the handle portions as illustrated by cover means 42 and 44 in FIGS. 2 and 3 for comfortable hand manipulation of the forceps.

As illustrated in FIG. 3, the jaw portions 16 and 18 are preferably offset from the plane of the handle portions 20 and 22 for jewelry practice. This offset feature provides clearance for relatively large beads while forming ferrules. To further assist in forming the seam-rounded ferrule of this invention, the forceps preferably include a biasing means to limit the movement of the lever members between an open and closed position. The biasing means can be a leaf spring, a coil spring or the like, which can be releasably attached to at least one of the handle portions.

A preferred biasing means is illustrated in FIGS. 2 and 3 as a thin leaf spring 70 having a first end 72 which is generally tapered and a second end 74 which is generally blunt. For convenience, and not by way of limitation, the leaf spring 70 is shown releasably attached to the handle portion 22 of forceps embodiment 10. As best seen in FIGS. 1 and 2, the first end 72 of the leaf spring 70 is preferably abutted against the lever member 20 adjacent the pivot means 24 to keep the jaw portions 16 and 18 in an open position when the forceps are not in use.

To assist in releasably attaching the leaf spring 70 to the handle portion 22 of forceps embodiment 10, the second end 74 of the leaf spring 70 is provided with a flange 76 and a male member 78 each projecting in parallel spaced relationship to one another. The handle portion 22 is provided with two slots 77 and 79 for cooperatively engaging each of the flange 76 and the male member 78, respectively. Thus, as seen in FIGS. 2 and 3, the leaf spring 70 is releasably secured to the handle portion 22 by the foregoing association of the flange 76 and the male member 78 and is maintained in such association by the protective cover means 42.

It is understood that the manner in which the biasing means is releasably attached is not critical and is not intended to be limited to the biasing means described.

As best seen in FIG. 3, the jaw portions 16 and 18 are preferably offset at an angle of about 30 degrees from the plane of the handle portions 16 and 18 and the leaf spring 70 is preferably attached on the top of the planar surface of the handle portion 22 from which the jaw portions 16 and 18 are offset.

The practice of the method of this invention is particularly suitable for use with securing cords of plastic-coated stainless steel wire in ferrules having a diameter up to about 0.12 inches (about 3 millimeters). Commercially, plastic-coated jewelry wire typically has a diameter in the range of about 0.012 inches (about 0.3 millimeters) to about 0,026 inches (about 0.65 millimeters).

Seamed-rounded ferrules for jewelry can be made from any ductile metal material, such as brass, sterling silver, copper, aluminum gold, platinum and alloys thereof. In the jewelry arts, it is usually difficult to achieve a taut grip on relatively hard stainless steel jewelry wire, such as tiger tail, with such relatively soft materials. However, the present method advantageously achieves such a taut grip with minimal required compressive force.

A particularly useful hand-holdable forceps as generally illustrated in FIGS. 2 and 3 that is suitable for use in forming ferrules by the method of this invention using ferrules that form an outside diameter up to about 0.12 inches (about 3 millimeters) has been found to have an overall lever member length of about 5 inches (about 12.7 centimeters), with the length of the jaw portions being about 0.75 inches (about 1.9 centimeters) and the length of the handle portions, being about 4.25 inches (about 12 centimeters).

The forceps can be constructed economically from stamped metal parts, such as from 3/32 inch steel and assembled in a manner analogous to that known in the pliers art.

The desired dies can be formed as part of the primary stamping process or in a separate machining operation. The dimensions of the dies are determined by the desired size and shape of the seam desired for the intermediate seamed ferrule and for the product seam-rounded ferrule. For a given diameter of ferrule, the seaming portion of the seam-forming die preferably is sized and shaped to securely hold the cord means within the duct of the seamed ferrule formed in the seam-forming step. The seam-rounding die preferably is dimensioned to receive the seamed ferrule as oriented at about right angles to the fulcrum of the seam-forming die. For convenience, the radius of the seam-rounding die can be substantially equal to the radius of the seam-forming die with the length of the seam-rounding die sized so that the cross-sectional area of the seam-rounding die, when the die members are in coactive position, being substantially less than the cross-sectional area of the seam-forming die.

It is also understood that the principles practiced herein can be applied wherever securement of cords to a connection member is desired using a ferrule.

It should be understood that various modifications, changes and variations may be made in the arrangement, operation and details of construction of the forceps, the method of forming ferrules, and the construction of a ferrule connector disclosed herein without departing from the spirit and scope of the invention. The present disclosure is intended to exemplify the invention and not to limit the invention.

What is claimed is:

1. A process for compression forming a formable ferrule in retaining engagement circumferentially about cord means that extends therethrough comprising the steps of:

(a) diametrically compressing said ferrule about said cord means so as to form said ferrule into a generally crescent configuration having in side elevation a concave side perimeter portion, a convex side perimeter portion that is in spaced, adjacent opposed relationship to said concave perimeter portion, and a pair of convex opposite end perimeter portions, and then (b) longitudinally compressing said opposite end perimeter portions so as to form said crescent configuration into a generally cardioid configuration having in side elevation a protruding region that is derived from said convex perimeter portion and a furrowed region that is derived from said concave portion.

2. The process of claim 1 wherein, between said diametrical compressing and said longitudinal compressing, said crescent configuration is reoriented spatially about 90° relative to the direction in which the compression force is exerted upon said crescent configuration.

3. The process of claim 2 wherein said compression force that is employed in said diametrical compressing and that is employed in said longitudinal compressing is manually applied through the jaws of a manually operated forceps.

4. The process of claim 1 wherein, during said diametrical compressing, said ferrule is positioned in a first die means which functions to conform said ferrule to said crescent configuration.

5. The process of claim 1 wherein, during said longitudinal compressing, said crescent configuration is positioned in a second die means which functions to conform said crescent configuration to said cardioid configuration.

6. The process of claim 1 wherein the total cross-sectional area of said cord means is in the range of about 1/5 to about 1/20 the cross-sectional area of a starting ferrule.

7. The process of claim 3 wherein said cord means is comprised of two cords, and each one of said cords is located in different respective opposite end region of said crescent configuration after said diametric compression, and each one of said cords is located adjacent a different axially extending side of said furrowed region after said longitudinal compression.

8. The combination of formed ferrule and retained cord means produced by the method of claim 1.

9. A method for compression forming a formable ferrule in retaining engagement circumferentially about cord members that extend therethrough comprising the steps of:

(a) extending at least two said cord members axially through a ferrule;

(b) diametrically compressing with an applied force said ferrule about said cord members while said ferrule is positioned in a first die means so as to form said ferrule into a generally crescent configuration in side elevation, said crescent configuration having:

(1) an axially extending concave side perimeter portion, (2) an axially extending convex side perimeter portion that is in adjacent, opposed relationship to said concave side perimeter portion, and (3) a pair of convex opposite end perimeter portions;

(c) removing said applied force;

(d) reapplying said force against said opposite end perimeter portions with said so configured ferrule being reoriented and positioned in a second die means so as to form said crescent configuration into a generally cardioid configuration in side elevation, said cardioid configuration having:

(1) a radially protruding axially extending region that is derived from said convex side perimeter portion, and (2) a radially furrowed, axially extending region that is derived from said concave side perimeter portion; and (e) removing said reapplied force.

10. The method of claim 9 wherein the number of cord members so extended through said ferrule is either two or four and wherein the total cross-sectional area of said so extended cord members is in the range of about 1/5 to about 1/20 the maximum cross-sectional open area enclosed by said ferrule initially.

11. The resulting combination of formed ferrule and retainingly engaged cord members produced by the method of claim 9.

12. A method of forming a seam-rounded ferrule about portions of a cord for jewelry comprising the steps of:

threading a free end of said cord through a ferrule having a circumferential side wall and a pair of axially spaced opposing end walls thereby to provide within said ferrule a first captured cord portion and also to provide between said captured portion and said free end a predetermined length of said cord;

further threading said free end back through said ferrule thereby to provide within said ferrule a second captured cord portion and to provide in said predetermined length a loop with said first and said second captured cord portions being in independent substantially parallel spaced adjacent relationship with respect to one another within said ferrule;

deforming said side wall to form a medial axially extending longitudinal indentation in said ferrule thereby to provide in said ferrule a pair of axially equally spaced, substantially parallel, longitudinally extending ducts, each said duct holding a different one of said first and said second cord portions; and compressing opposed portions of said side wall of said so deformed ferrule, said compressing being longitudinal in relation to said first and said second cord portions and being substantially perpendicular to said indentation thereby to fold said indentation longitudinally, radially and inwardly and provide a seam-rounded ferrule, having a cardioid configuration, such that said so compressed ferrule substantially immovably secures each of said first and said second cord portions.

13. The formed seam-rounded ferrule structure produced by the method according to claim 12.

14. The formed seam-rounded ferrule structure of claim 13 wherein said seam-rounded ferrule is composed of a ductile metal material selected from the group consisting of brass, sterling silver, copper, aluminum, gold, platinum and alloys thereof.

15. The formed semi-rounded ferrule structure of claim 13 wherein said seam-rounded ferrule so secures and holds said cord portions and said loop extends through a clasp connector for an article of jewelry and said cord is composed of jewelry wire.

16. The formed seam-rounded ferrule structure of claim 13 wherein said seam-rounded ferrule is a decorative jewelry bead for an article of jewelry.

17. The formed seam-rounded ferrule structure of claim 13 wherein said seam-rounded ferrule has a diameter such that said seam-rounded ferrule is slidably receivable within a channel defined in a terminal bead member of an article of jewelry.

* * * * *